United States Patent [19]

Kljucaricek

[11] 4,396,811

[45] Aug. 2, 1983

[54] D.C. POWER REVERSING SWITCH

[76] Inventor: Peter Kljucaricek, 30814 Morosso, Warren, Mich. 48093

[21] Appl. No.: 328,835

[22] Filed: Dec. 9, 1981

[51] Int. Cl.[3] ..... H01H 9/02

[52] U.S. Cl. ..... 200/1 V; 29/622

[58] Field of Search ..... 200/1 V, 158, 155 R; 29/622

[56] References Cited

U.S. PATENT DOCUMENTS 1,361,937 12/1920 Wagner et al. ..... 200/1 V 3,265,846 8/1966 Brechtel et al. ..... 200/1 V

*Primary Examiner*—A. T. Grimley

*Assistant Examiner*—Morris Ginsburg

*Attorney, Agent, or Firm*—William L. Fisher

[57] ABSTRACT

Improvement in a D.C. power reversing switch having a base having an insulator plate fast thereon and four spaced apart metal contact plates fast on the top side of the insulator plate, a manually moveable switch plate consisting of a second insulator plate and a pair of spaced apart metal jumper plates fast on the underside of the second insulator plate, a centrally disposed shaft upstanding from the base for rotatably holding the switch plate thereon, the switch having four separate contact areas thereon, the improvement comprising a clamp support fastened to the base, upstanding therefrom, extending over the switch plate and disposed above the four contact areas, and clamps operative between the support arrangement and the switch plate for pressing down thereupon at the centers of the four contact areas for forcing the jumper plates into face to face contact with the four contact plates.

6 Claims, 5 Drawing Figures

D.C. POWER REVERSING SWITCH

My invention relates to D.C. power reversing switches.

The principal object of my invention is the provision of an improved D.C. power reversing switch which is reliable and advantageous in use in providing minimum contact resistance while being durable in construction and economical to manufacture.

Figure 1:
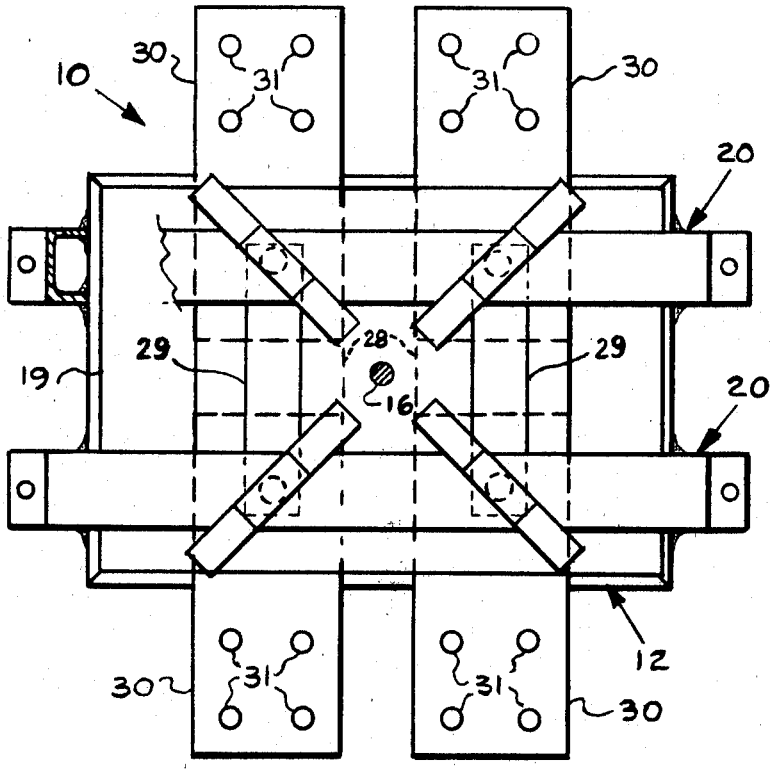
Figure 2:
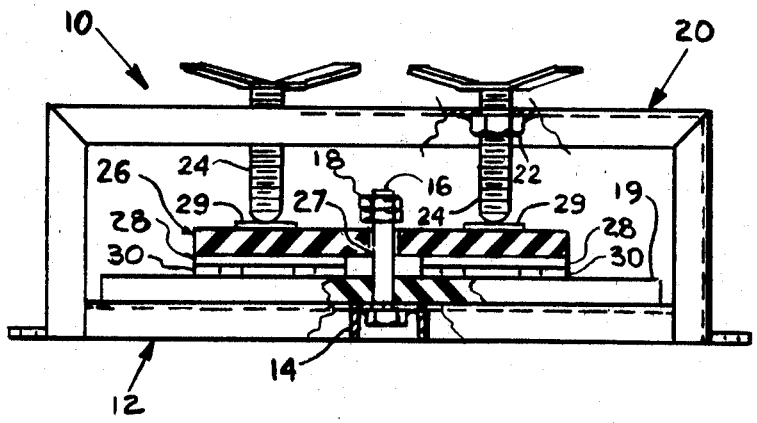
Figure 3:
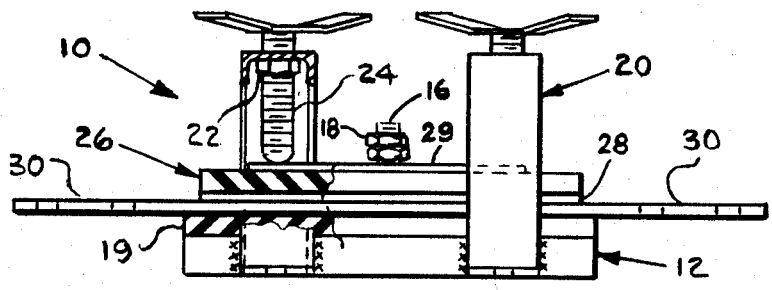
Figure 4:
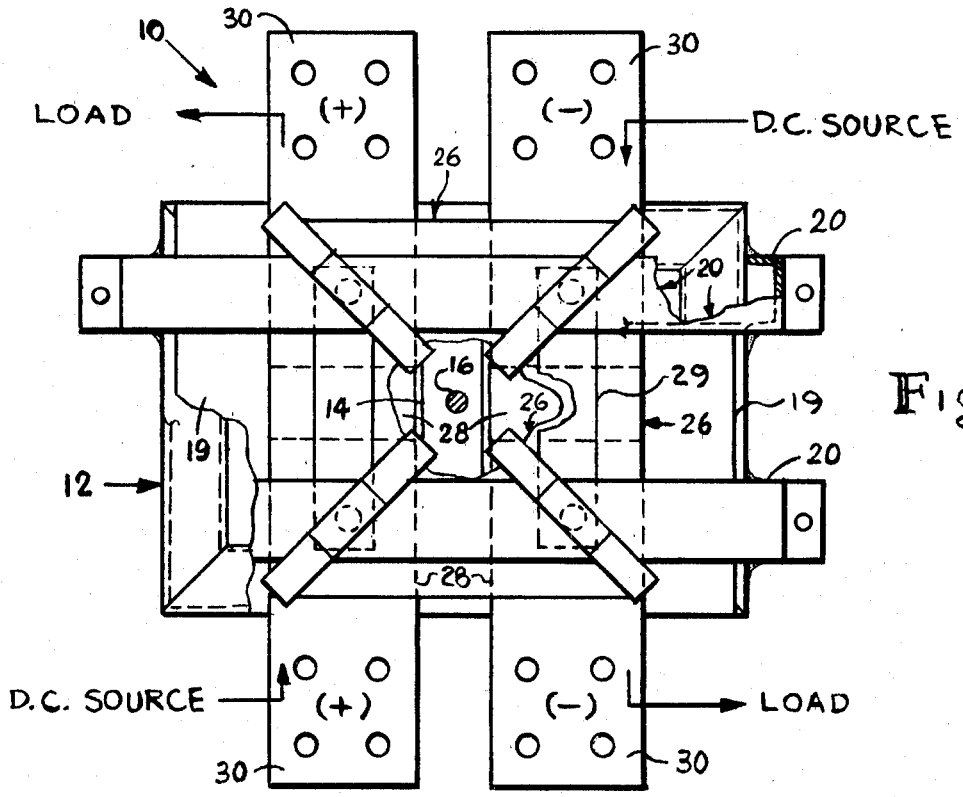
Figure 5:
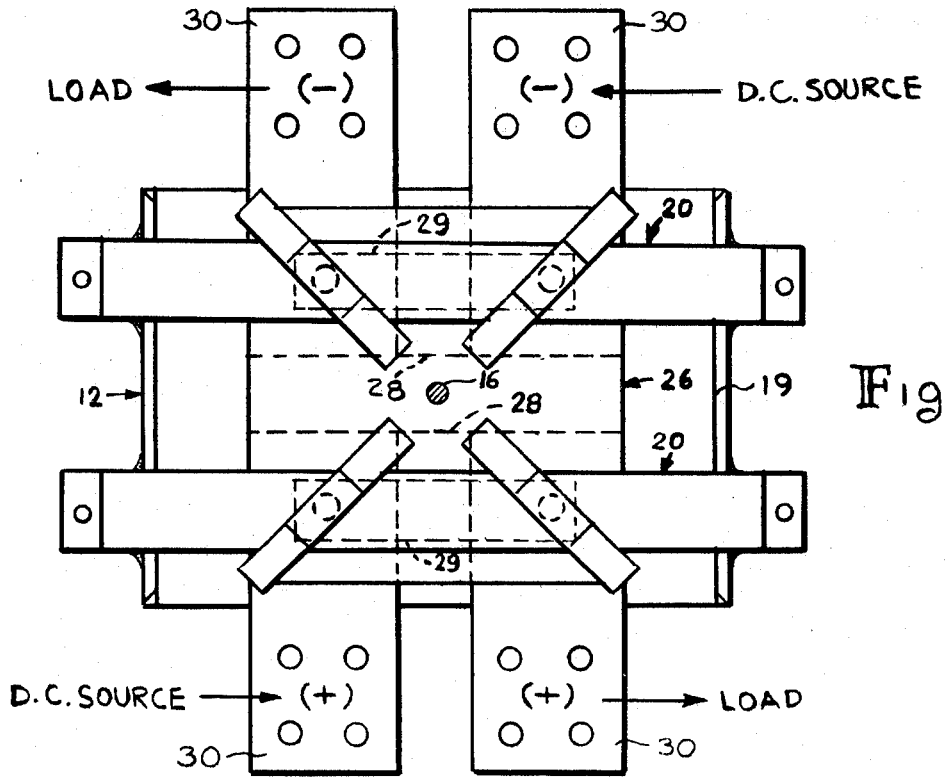

The foregoing object of my invention and the advantages thereof will become apparent during the course of the following description, taken in conjunction with the accompanying drawing, in which:

FIGS. 1–3 are, respectively, top plan, end and side elevational views of a D.C. power reversing switch embodying my invention; and FIGS. 4 and 5 are respective top plan views (with parts removed) thereof showing different operative positions.

Referring to the drawings in greater detail, 10 generally designates said embodiment which comprises a base 12 formed, in the instance, in a rectangle of suitable channel iron having a central cross-piece 14. An insulator plate 19 is fastened on top of the base 12 and four separate connector/metal contact plates 30 are fastened on top of the insulator plate 19. The connector portions of the plates 30 are provided with retention apertures 31 for joining suitable external D.C. conductors and project in pairs from both the front and back of the power switch 10. A manually moveable switch plate 26 is provided above the plates 30 consisting of an insulator plate and a pair of metal contact or jumper plates 28 fastened to the underside of said last-mentioned insulator plate. A central clearance aperture 27 is formed in said switch plate 26 through which an inverted bolt 16 extends to serve as a rotation axis for said switch plate 26. Said bolt 16 is welded to the cross-piece 14 and is provided with a pair of nuts 18 for retaining the switch plate 26 on the base 12 and in operative relation with the four contact portions on the inner ends of of the plates 30 which form the four contact areas of the switch 10. The switch plate 26 has a pair of metal clamping or wear plates 29 affixed to the top face of its insulator plate which are pressed upon by four wing-handled manual clamping bolts 24 threadably carried by nuts 22 affixed to a pair of bridges or clamp support members 20 welded to the base 12. The bridges or clamp support members 20 are spaced apart from each other front to back of the base 12, upstand therefrom and extend thereacross from side to side thereof so that the clamping bolts 24 are centered over the contact portions of the plates 30.

FIGS. 4 and 5 show the reversing switch 10 in use when a D.C. source is applied to alternate ones of the plates 30 and the load is taken off the other plates 30. In FIG. 4 the current passes in opposite directions from front to back of the power reversing switch 10 while in FIG. 5 the current passes in opposite directions from side to side thereof. To change the position of the switch 10 from that of FIG. 4 to that of FIG. 5, or vice versa, the clamping bolts 24 are loosened and the switch plate 26 is manually rotated so that the jumper plates 28 line up either front to back of the power switch 10, as in FIG. 4, or side to side thereof, as in FIG. 5. The clamping or wear plates 29 not only assist in pressing the jumper plates 28 upon the plates 30 but also serve as visible indicators of the position of the power reversing switch 10 showing the direction of travel of the current therethrough.

It will thus be seen that there has been provided by my invention an improved D.C. power reversing switch in which the object, hereinabove set forth, together with many thoroughly practical advantages, has been successfully achieved. While a preferred embodiment of my invention has been shown and described, it is to be understood that variations and changes may be resorted to without departing from the spirit of my invention as defined by the appended claims.

What I claim is:

1. Improvement in a D.C power reversing switch having a base having an insulator plate fast thereon and four spaced apart metal contact plates fast on the top side of said insulator plate, a manually moveable switch plate consisting of a second insulator plate and a pair of spaced apart metal jumper plates fast on the underside of said second insulator plate, a centrally disposed shaft upstanding from said base for rotatably holding said switch plate thereon, said switch having four separate contact areas thereon, the improvement comprising clamp support means fastened to said base, upstanding therefrom, extending over said switch plate and disposed above the four contact areas, and clamping means operative between said support means and said switch plate for pressing down thereupon at the centers of said four contact areas for forcing the jumper plates into face to face contact with said four contact plates.

2. Improvement in a D.C. power reversing switch as claimed in claim 1, said clamp support means consisting of a pair of support members spaced apart front to back of said switch and four clamping bolts carried two on each support member and centered over said four contact areas.

3. Improvement in a D.C. power reversing switch as claimed in claim 2 further comprising a pair of metal wear plates on the topside of said switch plate on which said clamping bolts press, said wear plates being aligned with said jumper plates so that they serve as visual indicators showing the direction of travel of the current through said switch.

4. Improvement in method of constructing a D.C. power reversing switch having a base having an insulator plate fast thereon and four spaced apart metal contact plates fast on the topside of on said insulator plate, a manually moveable switch plate consisting of a second insulator plate and a pair of spaced apart metal jumper plates fast on the underside of said second insulator plate, rotatably holding said switch plate on said base, said switch having four separate contact areas thereon, the improvement comprising providing clamp support means fastened to said base, upstanding therefrom, extending over said switch plate and disposed above the four contact areas, and providing clamping means operative between said support means and said switch plate for pressing down thereupon at the centers of the four contact areas for forcing the jumper plates into face to face contact with said four contact plates.

5. Improvement in method of constructing a D.C. power reversing switch, as claimed in claim 4, providing a pair of support members spaced apart from front to back of said switch, and providing four clamping bolts carried two on each support member and centered over said four contact areas.

6. Improvement in method of constructing a D.C. power reversing switch as claimed in claim 5 further comprising providing a pair of wear plates on the topside of said switch plate on which said clamping bolts press, aligning said wear plates with said jumper plates so that they serve as visual indicators showing the direction of travel of the current through said switch.

* * * * *